US006036515A

United States Patent [19]

Nakamura

[11] Patent Number: 6,036,515

[45] Date of Patent: Mar. 14, 2000

[54] CONNECTOR

[75] Inventor: Hideto Nakamura, Yokkaichi, Japan

[73] Assignee: Sumitomo Wiring Systems, Ltd., Japan

[21] Appl. No.: 09/128,382

[22] Filed: Aug. 3, 1998

[30] Foreign Application Priority Data

Aug. 26, 1997 [JP] Japan ..... 9-229834

[51] Int. Cl.[7] ..... H01R 29/00

[52] U.S. Cl. ..... 439/188; 439/489

[58] Field of Search ..... 439/188, 488, 439/489, 350, 357, 358, 509, 490, 595

[56] References Cited

U.S. PATENT DOCUMENTS

| | | | |
|---|---|---|---|
| 5,277,608 | 1/1994 | Oda . | |
| 5,462,449 | 10/1995 | Tsuji et al. | 439/188 |
| 5,647,754 | 7/1997 | Kohmo | 439/188 |
| 5,651,693 | 7/1997 | Fakuda et al. | 439/188 |
| 5,803,756 | 9/1998 | Furutani et al. | 439/188 |

FOREIGN PATENT DOCUMENTS

| | | |
|---|---|---|
| 0 758 806 | 2/1997 | European Pat. Off. . |
| 43 42 820 | 6/1994 | Germany . |
| 295 09 313 | 9/1995 | Germany . |
| 9-219257 | of 1997 | Japan . |

*Primary Examiner*—Khiem Nguyen
*Assistant Examiner*—J. F. Duverne
*Attorney, Agent, or Firm*—Anthony J. Casella; Gerald E. Hespos

[57] ABSTRACT

A fitting chamber 15 is formed with restricting ribs to be positioned in clearances between elastic contact portions 32 of a short-circuiting terminal fitting 30. When the short-circuiting terminal fitting 30 is mounted, a displacement of the elastic contact portions 32 along a direction in which they are arranged is restricted by the restricting ribs 17. As a result, the short-circuiting terminal fitting 30 is mounted securely in the fitting chamber 15 so as not to make any loose movement.

8 Claims, 8 Drawing Sheets

CONNECTOR

BACKGROUND OF THE INVENTION

1. Field of the Invention

The present invention relates to a connector provided with a short-circuiting terminal fitting.

2. Description of the Prior Art

A prior art connector with a short-circuiting terminal fitting is shown in FIGS. 7 and 8. This connector is constructed such that a plurality of terminal fittings 2 are mounted side by side in a connector housing 1. A short-circuiting terminal fitting 5 with a plurality of elastic contact portions 6 also is mounted in the connector housing 1 such that the elastic contact portions 6 individually can be brought into contact with the respective terminal fittings 2. The terminal fittings 2 are short-circuited by the contact of the elastic contact portions 6 before the connection with a mating connector housing (not shown). When the mating connector housing is connected, the elastic contact portions 6 are displaced upwardly to bring the terminal fittings 2 out of their short-circuited state. The connected state of the mating connector housing is detected based on whether or not the terminal fittings 2 are short-circuited.

A mount construction of the short-circuiting terminal fitting 5 in the above connector is as follows. Specifically; a fitting chamber 3 into which the short-circuiting terminal fitting 5 is inserted is formed in the connector housing 1, and a projection 4 is formed on the ceiling surface of the fitting chamber 3. On the other hand, the short-circuiting terminal fitting 5 is formed with a lock hole 7. The elastic contact portions 6 are bent in a V-shape, to extend along the insertion/withdrawal directions of the short-circuiting terminal fitting 5 into and from the fitting chamber 3 and are arranged side by side. When such a short-circuiting terminal fitting 5 is inserted into the fitting chamber 3, it can be so mounted as not to come out of the fitting chamber 3 by the engagement of the projection 4 and the lock hole 7.

Since the short-circuiting terminal fitting 5 is retained by the engagement of the projection 4 in the form of a small protuberance and the lock hole 7 in the above prior art connector, it may be loosely moved about this engaged portion along a transverse direction with respect to the insertion/withdrawal directions, that is a direction in which the elastic contact portions 6 are arranged.

In view of the above problem, it is an object of the present invention to securely mount a short-circuiting terminal fitting.

SUMMARY OF THE INVENTION

According to the invention, there is provided a connector which comprises a connector housing having a fitting chamber formed and a plurality of terminal fittings mounted inside. A short-circuiting terminal fitting is insertable into the fitting chamber and is formed with a plurality of elastic contact portions which are arranged substantially side by side so as to extend in insertion and withdrawal directions. The elastic contact portions of the short-circuiting terminal fitting can be brought into contact with the terminal fittings. The fitting chamber comprises a loose movement restricting means which is to be positioned in a clearance between the elastic contact portions to restrict the displacement of the elastic contact portions along the insertion or arrangement direction in which the elastic contact portions are arranged.

According to a preferred embodiment of the invention, the short-circuiting terminal fitting is insertable into the fitting chamber so as to be mounted therein in such a manner that a displacement thereof in a withdrawal direction is restricted by a disengagement restricting means.

According to a further preferred embodiment, there is provided a connector, comprising a connector housing having a fitting chamber and a plurality of terminal fittings mounted inside. A short-circuiting terminal fitting is insertable into the fitting chamber so as to be mounted therein in such a manner that a displacement thereof in a withdrawal direction is restricted by a disengagement restricting means. The short-circuiting terminal fitting is formed with a plurality of elastic contact portions which are arranged side by side so as to extend in insertion and withdrawal directions and which can be brought into contact with the terminal fittings. The fitting chamber comprises a loose movement restricting means which is positioned in a clearance between the elastic contact portions to restrict the displacement of the elastic contact portions along a direction in which the elastic contact portions are arranged.

Since the displacement of the elastic contact portions along their arranging direction is restricted by the loose movement restricting means, the short-circuiting terminal fitting can be securely mounted so as not to make any loose movement.

Preferably, any further displacement of the short-circuiting terminal fitting in the insertion direction is substantially restricted by the engagement of at least one contact portion formed at or on the short-circuiting terminal fitting and at least one receiving portion formed at or on the loose movement restricting means while the short-circuiting terminal fitting is substantially mounted in a proper position.

When the short-circuiting terminal fitting is inserted to the proper position, it is held such that the displacement thereof in the withdrawal direction is restricted by the disengagement restricting means and the displacement thereof in the insertion direction is restricted by the engagement of the contact portion and the receiving portion. This prevents the elastically deforming function of the elastic contact portions of the short-circuiting terminal fitting from being impaired by coming into contact with the back end surface of the fitting chamber.

Preferably, the contact portion is formed on the short-circuiting terminal fitting in a position corresponding to an upper end of the clearance, where the two or more elastic contact portions are connected on or at the short-circuiting terminal fitting.

Further preferably, the receiving portion is substantially formed by a front portion of a step-like projection of the loose movement restricting means.

Still further preferably, the loose movement restricting means comprises one or more ribs projecting into the fitting chamber in the insertion direction. The positions of the ribs substantially correspond to those of the clearances upon insertion of the short-circuiting terminal fitting into the fitting chamber.

Most preferably, the width of the ribs is substantially equal to or smaller than the width of the clearance(s).

These and other objects, features and advantages of the present invention will become more apparent upon a reading of the following detailed description and accompanying drawings.

DETAILED DESCRIPTION OF THE PREFERRED EMBODIMENTS

Figure 1:
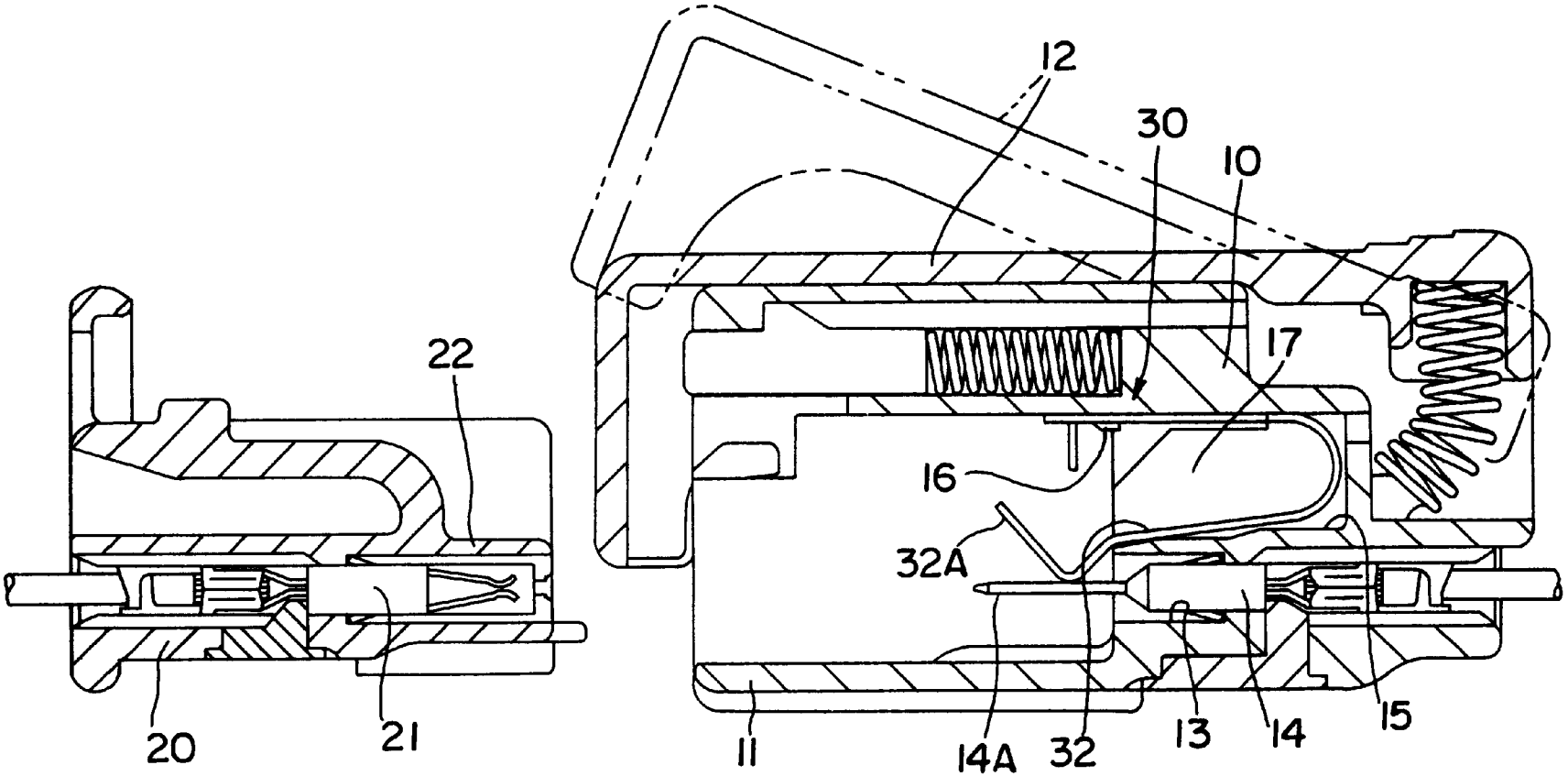
FIG. 1 is a section of one embodiment before two connector housings are connected.

A male connector housing in accordance with the subject invention is identified by the numeral 10 in FIGS. 1–6. The male connector housing 10 is provided with a receptacle 11 into which a female connector housing 20 is at least partially fittable. A cover 12 is provided for substantially closing and substantially opening of the receptacle 11. At a lower part of the male connector housing 10, a plurality of cavities 13 (three in this embodiment) are formed substantially side by side, and preferably substantially parallel to each other. The cavities 13 are open in the back end surface of the receptacle 11. Male terminal fittings 14 are accommodated in the respective cavities 13, and tabs 14A thereof project into the receptacle 11.

Above or near the cavities 13 is formed a fitting chamber 15 for accommodating a short-circuiting terminal fitting 30. This fitting chamber 15 defines a large opening in the back end wall of the receptacle 11 (as seen from an insertion direction of the female connector housing 20 into the receptacle 11). A projection 16 is formed in a position of the ceiling surface of the fitting chamber 15 near its front end. The projection 16 (disengagement restricting means) is provided for retaining and/or positioning the short-circuiting terminal fitting 30 so as not to come out of the fitting chamber 15. The rear surface of this projection 16 serves as a locking surface 16A which extends in a direction at an angle different from 0° or 180°, preferably substantially normal to the insertion/withdrawal directions of the short-circuiting terminal fitting 30 into and from the fitting chamber 15. The front surface of the projection 16 serves as a guide surface 16B which is slanted with respect to the insertion/withdrawal directions.

Figure 3:
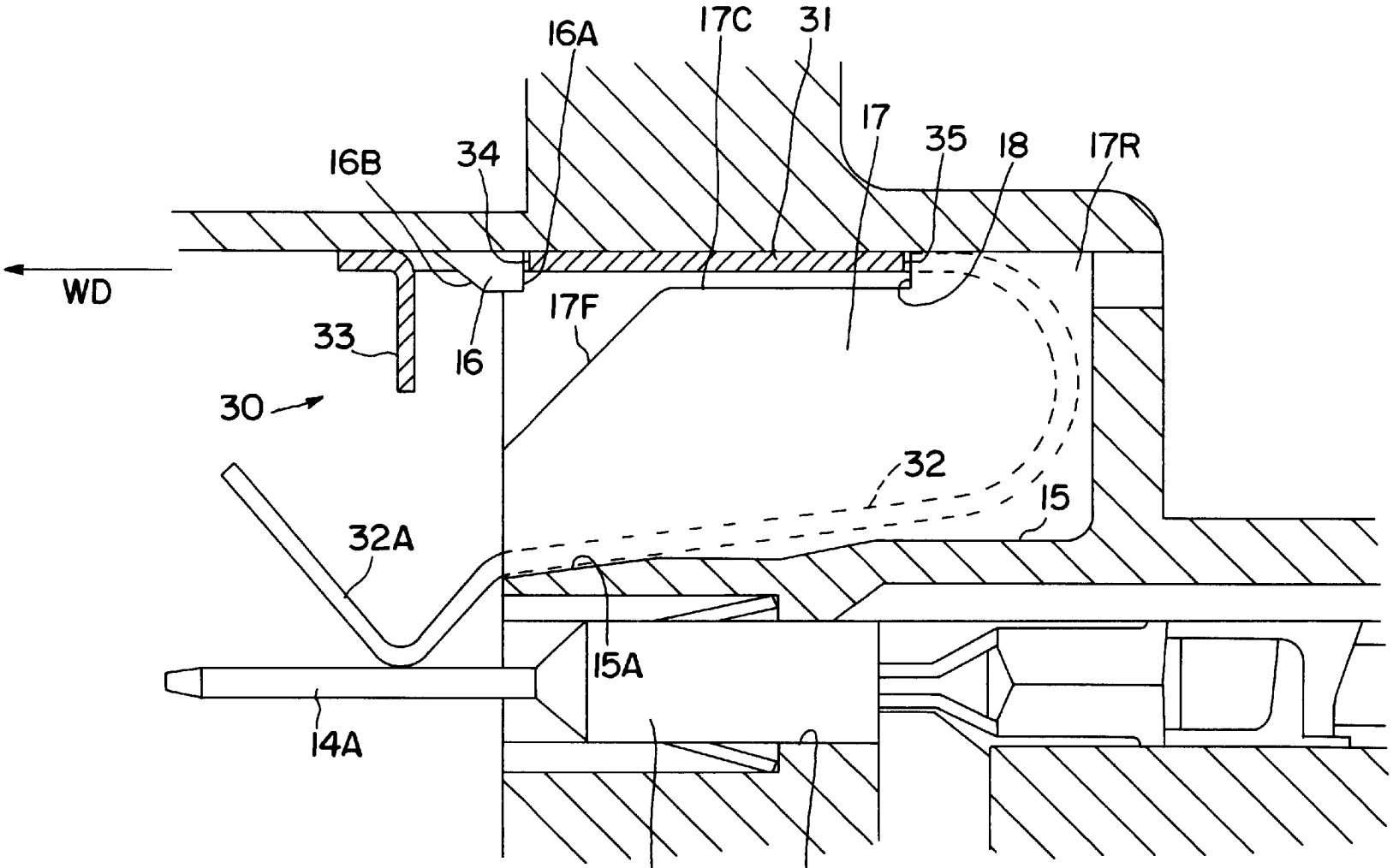
FIG. 3 is an enlarged partial section showing a mount construction for the short-circuiting terminal fitting according to the embodiment.
Figure 4:
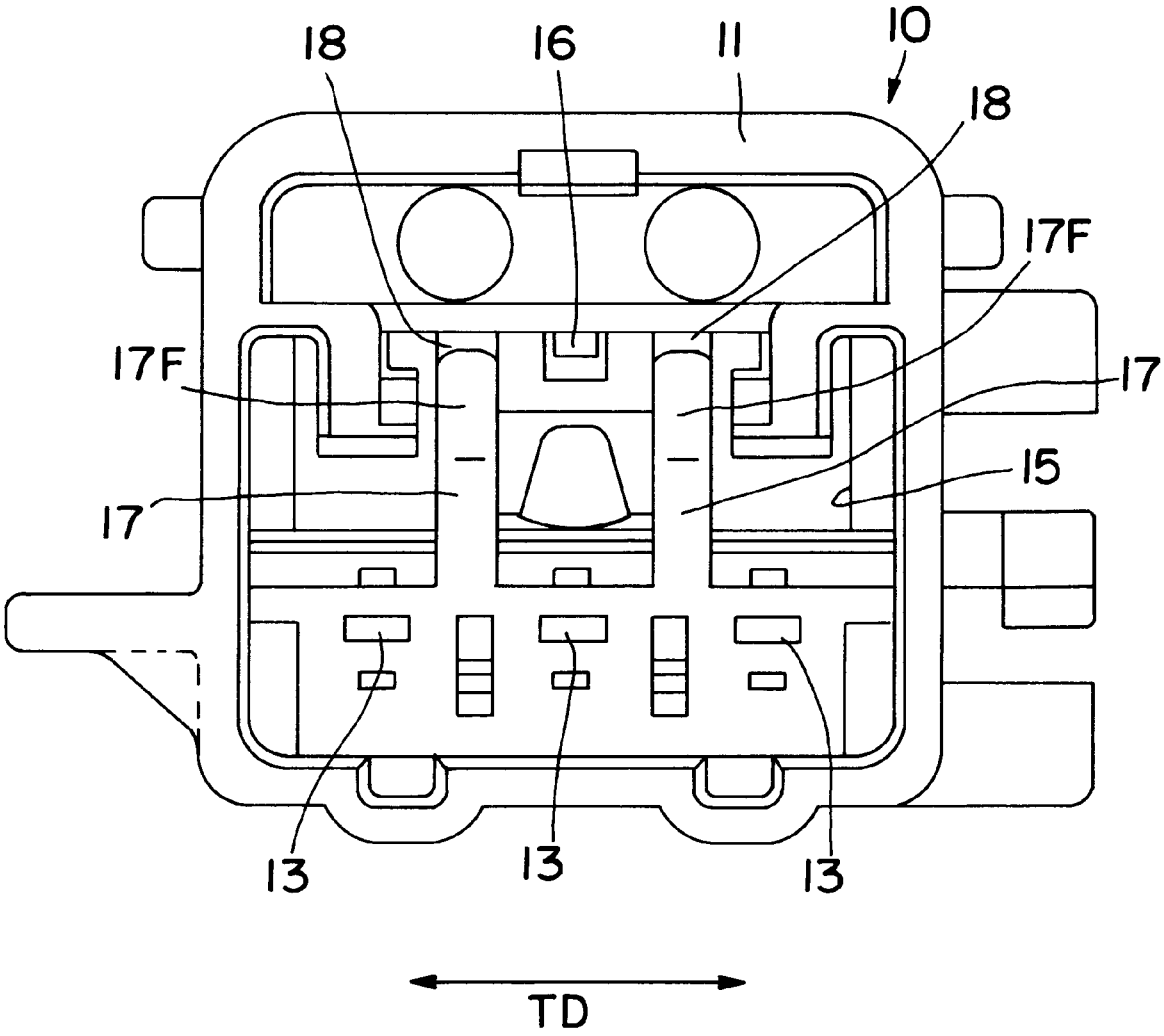
FIG. 4 is a front view of the male connector housing with the short-circuiting terminal fitting detached.

The fitting chamber 15 is formed with restricting ribs 17 (loose movement restricting means) for restricting a loose movement of the accommodated short-circuiting terminal fitting 30. This restricting ribs 17 stand on the bottom surface of the fitting chamber 15 from the front end to the rear end as shown in FIG. 3, and are arranged in one or more, preferably at least in two spaced positions along the transverse direction TD of the connector when viewed from the front surface as shown in FIG. 4. The width W and position of the two restricting ribs 17 along the transverse direction TD correspond to the width and position of the clearances 32C between elastic contact members 32 of the short-circuiting terminal fitting 30 to be described later.

An upper edge 17C of a central part of each restricting rib 17 along forward and backward directions has such a height that only a narrow clearance is defined between the upper edge 17C and the ceiling surface of the fitting chamber 15 (FIG. 3). The width of this clearance is larger than the thickness of a terminal main body 31 of the short-circuiting terminal fitting 30 to be described later. An upper edge 17F of a front part of each restricting rib 17 is a slanted surface which extends downwardly to the front from the front end of the upper edge 17C of the central part. An upper end 17R of a rear part of each restricting rib 17 stands stepwise from the rear end of the upper edge 17C of the central part so as to be in contact with the ceiling surface of the fitting chamber 15. The front surface of this steplike portion serves as a receiving portion 18 which can be brought into contact with a contact portion 35 of the short-circuiting terminal fitting 30.

Figure 6:
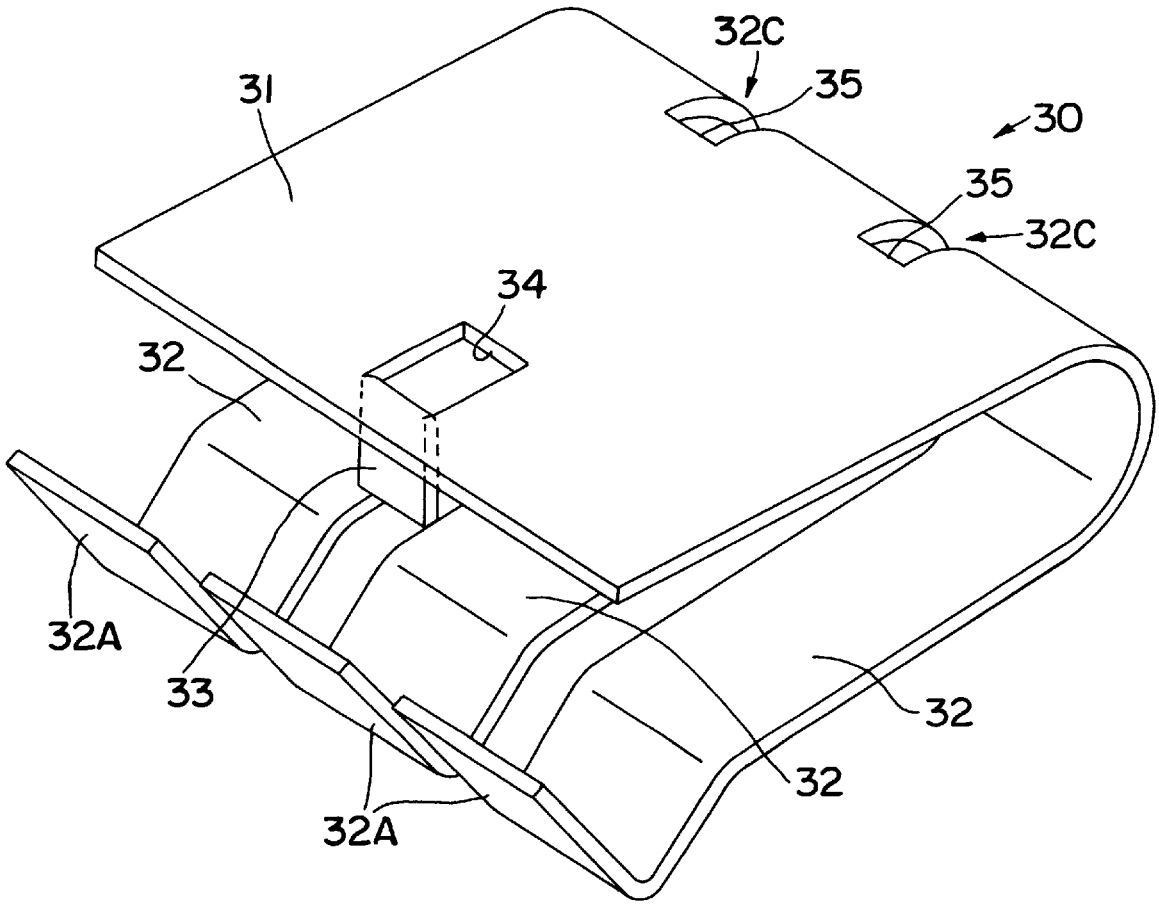
FIG. 6 is a perspective view of the short-circuiting terminal fitting.
Figure 7:
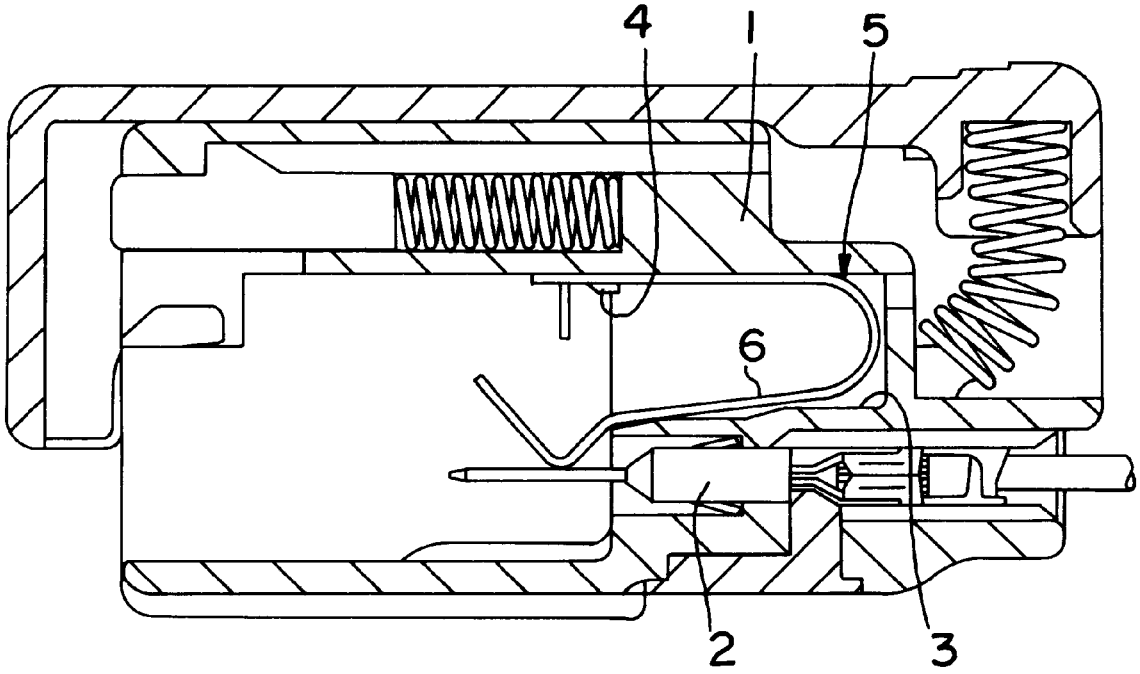
FIG. 7 PRIOR ART
FIG. 7 is a section of a prior art connector.
Figure 8:
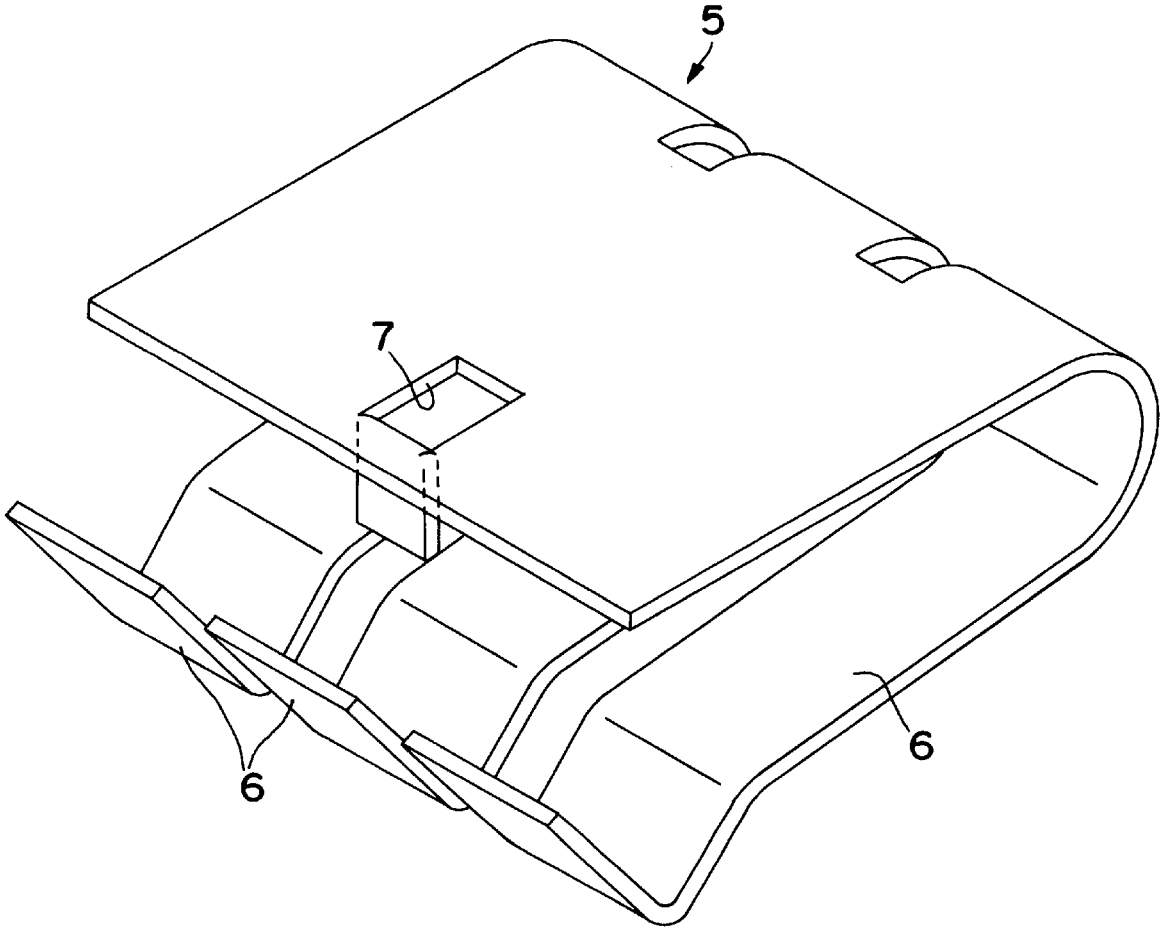
FIG. 8 PRIOR ART
FIG. 8 is a perspective view of the short-circuit terminal of the prior art connector.

The short-circuiting terminal fitting 30 is so made, e.g. from a conductive metal plate, as to have a substantially U-shaped shape opening forwardly when viewed sideways as shown in FIGS. 3 and 6, and is comprised of the rectangular terminal main body 31 and a plurality (three in this embodiment) of elastic contact portions 32 which are folded backwardly and downwardly from the rear end of the terminal main body 31.

The terminal main body 31 can be substantially brought into close contact with the ceiling surface of the fitting chamber 15 over a large area except a rear end portion (right end portion of FIG. 3). In a center position of the front end of the terminal main body 31 along the transverse direction, a projection 33 is formed by cutting and bending down and a lock hole 34 (disengagement restricting means) is left in the terminal main boy 31 as a result of forming the projection 33. A displacement of the short-circuiting terminal fitting 30 in its withdrawal direction from the fitting chamber 15 is substantially restricted by the engagement of the lock hole 34 and the projection 16. The projection 16 and the lock hole 34 can be disengaged by lowering the terminal main body 31 while gripping the projection 33. The contact portions 35 which can be brought into contact in an arrangement or insertion direction AD with the receiving portions of the restricting ribs 17 are formed in two positions of the rear end of the terminal main body 31 where the elastic contact portions 32 are not formed.

Figure 2:
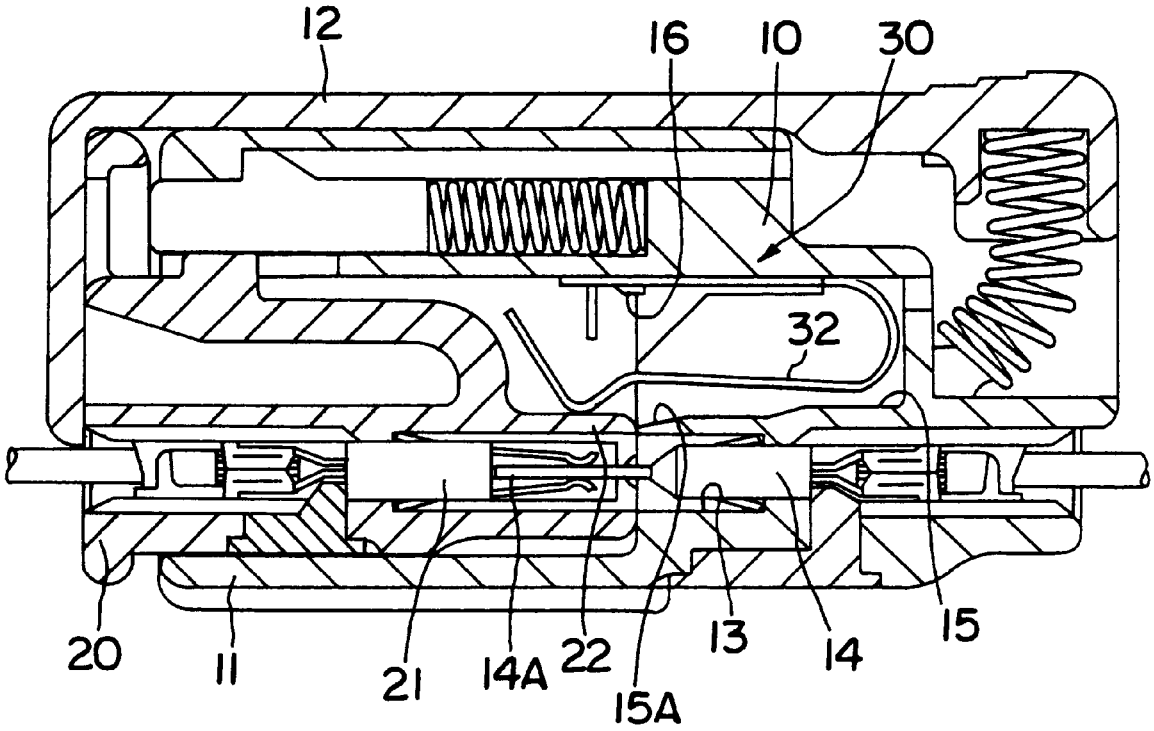
FIG. 2 is a section of the embodiment after the two connector housings are connected.

The (three) elastic contact portions 32 are arranged substantially side by side so as to correspond to the (three) tabs 14A of the male terminal fittings 14 in a transverse direction when viewed from the front and preferably have each a substantially J-shape extending from the rear edge of the terminal main body 31 when viewed sideways (FIGS. 1–3). These elastic contact portions 32 are elastically deformable in a direction to substantially close the opening at the front end of the short-circuiting terminal fitting 30 while being accommodated in the fitting chamber 15. The terminal main body 31 and the elastic contact portions 32 are elastically in contact with the ceiling surface and the bottom surface of the fitting chamber 15, respectively, by the elastic restoring forces of the elastic contact portions 32. A front part, preferably half, of the bottom surface is a slanted surface 15A which is sloped downwardly and moderately to the front. The elastic contact portions 32 come into substantially close contact with this slanted surface 15A. Front end portions of the elastic contact portions 32 projecting from the bottom surface are substantially V-shaped contact pieces 32A, which are brought or bringable elastically into contact with the upper surfaces of the tabs 14A of the male terminal fittings 14.

The female connector housing 20 to be fitted into the receptacle 11 of the male connector housing 10 is provided internally with female terminal fittings 21 substantially corresponding to the male terminal fittings 14. The upper surface of a front end portion of the female connector housing 20 serves as a push-up portion 22 for displacing the short-circuiting terminal fitting 30 in a direction away from the tabs 14A during the connection of the female connector housing 20 with the male connector housing 10.

With the short-circuiting terminal fitting 30 mounted in the fitting chamber 15, the male terminal fittings 14 are short-circuited via the short-circuiting terminal fitting 30 (see FIG. 1) since the contact pieces 32A of the respective elastic contact portions 32 are in contact with the corresponding tabs 14A. When the female connector housing 20 is connected in this state, the push-up portion 22 is engaged substantially with the contact pieces 32A of the elastic contact portions 32, thereby displacing them away from the tabs 14A, preferably substantially upwardly. As a result, the elastic contact portions 32 move away from the tabs 14A, thereby releasing the short-circuited state of the male terminal fittings 14 (see FIG. 2). In other words, whether or not the female connector housing is connected properly can be detected by detecting whether or not the male terminal fittings 14 are short-circuited. In the case that this connector is connected with a circuit for an air bag, the actuation of the air bag can be prevented by bringing the male terminal fittings 14 into the short-circuited state when the female connector housing 20 is disconnected for a maintenance or the like.

In mounting the short-circuiting terminal fitting 30 substantially in the fitting chamber 15, the short-circuiting terminal fitting 30 is inserted substantially into the fitting chamber 15 by being faced backwardly with the clearances between the elastic contact members substantially aligned with the restricting ribs 17. Then, the terminal main body 31 smoothly comes into sliding contact with the lower end surface of the projection 16 by the guided surface 16B of the projection 16, and the lower surfaces of the elastic contact portions 32 come into sliding contact with the bottom surface of the fitting chamber 15. As a result, the short-circuiting terminal fitting 30 is deformed slightly elastically along the vertical direction as a whole.

Figure 5:
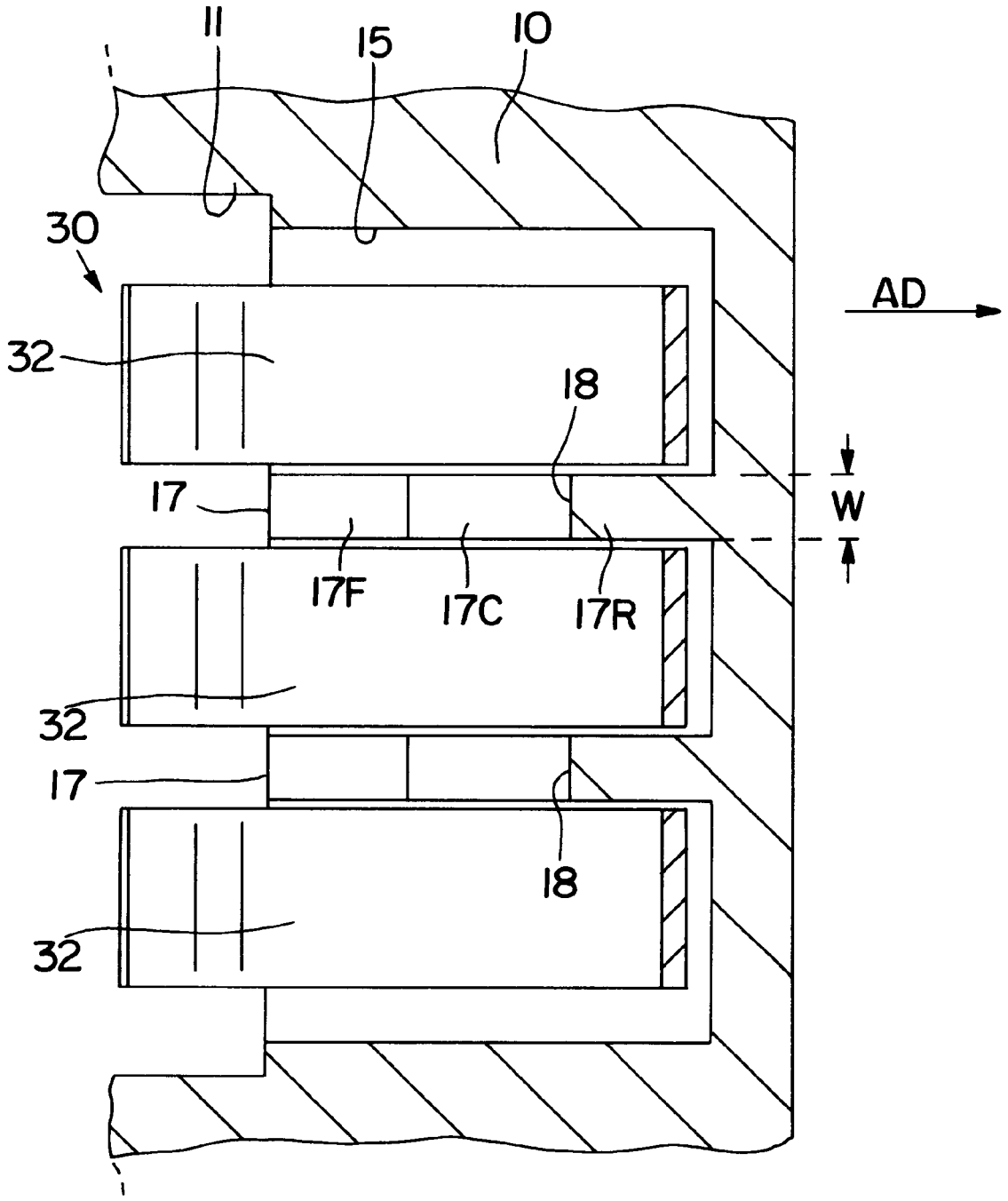
FIG. 5 is an enlarged partial plan view showing a positional relationship between the short-circuiting terminal fitting and restricting ribs.

If the short-circuiting terminal fitting 30 is pushed further into the fitting chamber 15, it reaches a proper mount position. Then, the lock hole 34 is aligned substantially with the projection 16; the terminal main body 31 is brought elastically into contact with the ceiling surface of the fitting chamber 15 by the elastic restoring force of the short-circuiting terminal fitting 30; and the locking surface 16A of the projection 16 is engaged with an edge of the lock hole 34. As a result, a displacement of the short-circuiting terminal fitting 30 in its withdrawal direction from the fitting chamber 15 can be restricted. Simultaneously, the contact portions 35 of the short-circuiting terminal fitting 30 substantially come into contact with the receiving portions of the restricting ribs 17, thereby preventing the short-circuiting terminal fitting 30 from being pushed any further in the arrangement or insertion direction AD (FIG. 5). In this state, arcuate portions of the elastic contact portions 32 at their rear ends are not in contact with the back end surface of the fitting chamber 15.

With the short-circuiting terminal fitting 30 mounted in the fitting chamber 15, the restricting ribs 17 are located in the clearances between the three elastic contact portions 32, and the width of the restricting ribs 17 is substantially equal to that of the clearances between the elastic contact portions 32. Accordingly, loose movements of the elastic contact portions 32 along the transverse direction are restricted. Thus, displacement of the short-circuiting terminal fitting 30 along the transverse direction TD and rotation thereof about the engaging portion of the projection 16 and the lock hole 34 are prevented, with the result that the short-circuiting terminal fitting 30 can be held securely in a specified mount position.

During the mounting of the short-circuiting terminal fitting 30 in the fitting chamber 15, the short-circuiting terminal fitting 30 is positioned substantially along the transverse direction TD by the engagement of the restricting ribs 17 and the elastic contact portions 32. Accordingly, even if the short-circuiting terminal fitting 30 has a narrower width than the fitting chamber 15, it can be mounted along a specified path to engage securely the projection 16 and the lock hole 34.

Further, the elastic contact portions 32 are held out of contact of the back end surface of the fitting chamber 15 since any further displacement of the short-circuiting terminal fitting 30 toward the back of the fitting chamber 15 is restricted by the engagement of the contact portions 35 of the short-circuiting terminal fitting 30 and the receiving portions 18 of the restricting ribs 17. This prevents the movements of the elastic contact portions 32 toward and away from the tabs 14A from being hindered due to the interference of the elastic contact portions 32 with the back end surface of the fitting chamber 15.

The present invention is not limited to the described and illustrated embodiment, but the following embodiments are also embraced by the technical scope of the present invention as defined in the claims. Besides the following embodiments, a variety of other changes can be made without departing from the scope and spirit of the invention as defined in the claims.

Although there are three elastic contact members in the foregoing embodiment, the number thereof may be two, four or more according to the invention.

Although the male connector housing 10 is provided with the cover 12 for preventing the entrance of dust in the foregoing embodiment, the invention is also applicable to connectors without the cover 12.

Although the short-circuiting terminal fitting 30 substantially has a U-shape when viewed sideways in the foregoing embodiment, the invention is also applicable to short-circuiting terminal fittings having other shapes.

What is claimed is:

1. A connector, comprising:

a connector housing having a plurality of substantially parallel terminal cavities and a fitting chamber formed therein, the fitting chamber having a bottom wall separating said fitting chamber from said terminal cavities and a ceiling surface facing the bottom wall and spaced therefrom;

a plurality of terminal fittings mounted in the respective terminal cavities a short-circuiting terminal fitting inserted in the fitting chamber along an insertion direction and formed with a main body disposed against the ceiling surface of the fitting chamber, a plurality of substantially parallel elastic contacts extending unitarily from the main body and spaced from one another by clearances, each said elastic contact being substantially J-shaped and having a base portion extending from the main body in the insertion direction, a curved portion extending from the base portion and curving downwardly toward the bottom wall of the fitting chamber and a contact portion extending from the curved portion and continuing along a withdrawal direction substantially opposite to the insertion direction, said elastic contacts being biased into contact with the terminal fittings, and being deflectable away from the terminal fittings by a mating connector; and at least one restricting rib formed in the fitting chamber of the connector housing and extending from the bottom wall thereof to the ceiling surface, said at least one fitting rib extending through said clearance between the elastic contact portions for restricting displacement of the short-circuiting terminal fitting in directions transverse to the insertion direction.

2. A connector according to claim 1, wherein the connector housing includes disengagement restricting means extending into the fitting chamber for resisting displacement of the short-circuiting terminal fitting in the withdrawal direction.

3. A connector, comprising:

a connector housing having a plurality of terminal cavities and a fitting chamber formed therein;

a plurality of terminal fittings mounted in the respective terminal cavities;

a short-circuiting terminal fitting inserted in the fitting chamber and formed with a plurality of elastic contact portions arranged side by side so as to extend in insertion and withdrawal directions, said elastic contact portions being biased into contact with the terminal fittings, and being deflectable away from the terminal fittings by a mating connector;

wherein the fitting chamber comprises a loose movement restricting means positioned in a clearance between the elastic contact portions to restrict the displacement of the elastic contact portions along directions transverse to the insertion direction; and wherein the connector housing includes disengagement restricting means extending into the fitting chamber for resisting displacement of the short-circuiting terminal fitting in the withdrawal direction; and wherein displacement of the short-circuiting terminal fitting in the insertion direction beyond a specified position is substantially restricted by engagement of at least one contact portion formed on the short-circuiting terminal fitting and at least one receiving portion formed on the loose movement restricting means.

4. A connector according to claim 3, wherein elastic contact portions project from a terminal main body of the short-circuiting terminal fitting, and wherein the contact portion is formed on portions of the terminal main body between the elastic contact portions.

5. A connector according to claim 4, wherein the receiving portion is formed by a front portion of a step-like projection of the loose movement restricting means.

6. A connector according to claim 1, wherein the rib has a width no greater than a width defined by the clearance between the elastic contact portions.

7. A connector according to claim 1, wherein the short-circuiting terminal fitting has at least three of said elastic contacts and at least two of said clearances, and wherein the at least one rib comprises at least two ribs disposed respectively in the clearances between the elastic contact portions, said ribs being aligned substantially parallel to one another.

8. A connector according to claim 1, wherein portions of said rib adjacent said ceiling surface are substantially adjacent the main body of the short-circuiting terminal fitting for restricting displacement of the short-circuit terminal fitting in the insertion direction.

* * * * *